US006888113B2

(12) United States Patent
Monda et al.

(10) Patent No.: US 6,888,113 B2
(45) Date of Patent: May 3, 2005

(54) HEATING DEVICE AND FUSER UTILIZING ELECTROMAGNETIC INDUCTION

(75) Inventors: Yuichi Monda, Fukuoka (JP); Eiji Torikai, Fukuoka (JP); Kazuhiko Soeda, Fukuoka (JP); Tadayuki Kajiwara, Fukuoka (JP); Tadafumi Shimizu, Fukuoka (JP); Shouichi Kitagawa, Fukuoka (JP); Masahiro Samei, Fukuoka (JP); Kazunori Matsuo, Fukuoka (JP); Keiichi Matsuzaki, Fukuoka (JP); Kenji Asakura, Kyoto (JP); Hideki Tatematsu, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/757,988

(22) Filed: Jan. 16, 2004

(65) Prior Publication Data

US 2004/0226940 A1 Nov. 18, 2004

(30) Foreign Application Priority Data

Jan. 17, 2003 (JP) ..... P. 2003-009451
Jan. 31, 2003 (JP) ..... P. 2003-023828

(51) Int. Cl.[7] ..... H05O 6/40
(52) U.S. Cl. ..... 219/619; 399/330
(58) Field of Search ..... 219/619, 674, 219/216, 670, 676, 636, 661, 667, 618; 399/330, 328, 331, 333, 334

(56) References Cited

U.S. PATENT DOCUMENTS 5,552,582 A 9/1996 Abe et al.
5,752,150 A 5/1998 Kato et al.
5,819,150 A 10/1998 Hayasaki et al.
5,999,774 A 12/1999 Masuda et al.
6,252,212 B1 * 6/2001 Takagi et al. ..... 219/619
6,320,168 B1 * 11/2001 Kimata et al. ..... 219/619
6,577,839 B2 * 6/2003 Samei ..... 399/328
6,625,417 B1 * 9/2003 Terada et al. ..... 399/328
2003/0000944 A1 1/2003 Takagi et al.

FOREIGN PATENT DOCUMENTS

| | | |
|---|---|---|
| EP | 1174774 | 1/2002 |
| JP | 7-295414 | 11/1995 |
| JP | 8-22206 | 1/1996 |
| JP | 9-016006 | 1/1997 |
| JP | 0-074007 | 3/1998 |
| JP | 10-074011 | 3/1998 |
| JP | 1-297462 | 10/1999 |
| JP | 1-188430 | 7/2001 |
| JP | 1-313162 | 11/2001 |
| JP | 2-221864 | 8/2002 |

OTHER PUBLICATIONS

English Language Abstract of JP2001–313162.
English Language Abstract ofJP 2002–221864.
English Language Abstract of JP9–016006.
English Language Abstract of JP11–297462.
English Language Abstract of JP7–295414.
English Language Abstract of JP10–074007.
English Language Abstract of JP2001–188430.

* cited by examiner

*Primary Examiner*—Quang T. Van
(74) *Attorney, Agent, or Firm*—Greenblum & Bernstein, P.L.C.

(57) ABSTRACT

A heating device utilizing electromagnetic induction is provided with an induction heating unit that is opposed to a heating member and causes the heating member to heat through electromagnetic induction. The induction heating unit has an exciting coil for generating a magnetic field and a coil guide member on which the exciting coil is wound. The exciting coil is formed in at least two layers in such a manner that a first layer is formed on a circumferential surface of the coil guide member by winding a plurality of turns and a second layer is formed around and outside the first layer on the side opposite to the coil guide member, and winding of each of the second layer and following layers is started from a position close to a winding start position of the first layer.

10 Claims, 8 Drawing Sheets

HEATING DEVICE AND FUSER UTILIZING ELECTROMAGNETIC INDUCTION

BACKGROUND OF THE INVENTION

The present invention relates to a fuser that is used in an electrostatic recording type image forming apparatus such as a copying machine, a facsimile, and a printer. More specifically, the invention relates to a heating device and a fuser utilizing electromagnetic induction.

In recent years, in image forming apparatus such as printers, copiers, and facsimiles, market requirements about the energy consumption and the processing speed have become higher. To attain performance that meets those requirements, it is important to increase the thermal efficiency of fusers that are used in image forming apparatus.

In image forming apparatus, an unfused toner image is formed on a recording medium such as a recording sheet, printing paper, photosensitive paper, or electrostatic recording paper by an image transfer type or direct type image forming process such as xerography, electrostatic recording, or magnetic recording. Fusers of contact heating types such as a heat roller type, a film heating type, and an electromagnetic induction heating type are widely employed as fusers for fusing an unfused toner image.

JP-A-8-22206 proposes an electromagnetic induction heating type fuser that utilizes a technique of causing a magnetic metal member as a heating member to generate heat (Joule heat) by electromagnetic induction, that is, by creating eddy current in the magnetic metal member by an AC magnetic field generated by an exciting coil as an induction heating means.

The AC magnetic field generated by the energized exciting coil is not uniform over the entire range and hence the heat generation of the heating member may not be uniform.

This may cause toner fusing unevenness and deteriorate the printing quality.

SUMMARY OF THE INVENTION

In view of the above, an object of the present invention is to provide a heating device and a fuser utilizing electromagnetic induction in which an exciting coil can cause a heating member to heat uniformly without unevenness.

To solve the above problem, the invention provides a heating device utilizing electromagnetic induction which has a heating member and induction heating means opposed to the heating member for causing the heating member to heat through electromagnetic induction, wherein the induction heating means comprises an exciting coil for generating a magnetic field and a coil guide member on which the exciting coil is wound, and wherein the exciting coil is formed in at least two layers in such a manner that a first layer is formed on a circumferential surface of the coil guide member by winding a plurality of turns and a second layer is formed around and outside the first layer on a side opposite to the coil guide member, and that winding of each of the second layer and following layers is started from a position close to a winding start position of the first layer. With this configuration, the last turn (one coil rotation around the circumferential surface of the coil guide member will be hereinafter called a turn) of the first layer is not laid on the first turn of the second layer that is located outside the first layer. Therefore, no magnetic field concentration occurs near the bottom opening of the coil guide member and a magnetic flux that leaks from the opening of the coil guide member (i.e., a useless magnetic field that does not act on the heating member) is reduced. The heating member is not influenced by an unstable magnetic field occurring in the end portion of the exciting coil. This provides an advantageous effect that the induction heating means can cause the heating member to heat uniformly without unevenness.

Since the first turn of the second layer starts from the position close to the first turn of the first layer, the profile of the voltage difference between the first and second layers is almost uniform and has no unduly-high-voltage portions, which decreases the causes of current leakage between wire sections. Since the winding start position and end position of are distant from each other, a long insulation distance can be secured between them, which also decreases the causes of current leakage and makes it possible to provide a stable exciting coil.

Further, since winding is performed from the top portion of the coil guide member where the winding width is small toward the bottom opening where the winding width is large, the coil can be wound stably without coming loose. The production efficiency can thereby be increased.

According to first aspect of the invention, it is provided a heating device utilizing electromagnetic induction which has a heating member and induction heating means opposed to the heating member for causing the heating member to heat through electromagnetic induction, wherein the induction heating means comprises an exciting coil for generating a magnetic field and a coil guide member on which the exciting coil is wound, and wherein the exciting coil is formed in at least two layers in such a manner that a first layer is formed on a circumferential surface of the coil guide member by winding a plurality of turns and a second layer is formed around and outside the first layer on a side opposite to the coil guide member, and that winding of each of the second layer and following layers is started from a position close to a winding start position of the first layer. With this configuration, no magnetic field concentration occurs near the bottom opening of the coil guide member and a magnetic flux that leaks from the opening of the coil guide member (i.e., a useless magnetic field that does not act on the heating member) is reduced. The heating member is not influenced by an unstable magnetic field occurring in the end portion of the exciting coil. This provides an advantageous effect that the induction heating means can cause the heating member to heat uniformly without unevenness.

Since the first turn of the second layer starts from the position close to the first turn of the first layer, the profile of the voltage difference between the first and second layers is almost uniform and has no unduly-high-voltage portions, which decreases the causes of current leakage between wire sections. Since the winding start position and end position are distant from each other, a long insulation distance can be secured between them, which also decreases the causes of current leakage. As a result, an advantageous effect is obtained that a stable exciting coil can be provided.

According to second aspect of the invention, the coil guide member comprises an opening and a housing that is curved so as to cover the heating member and accommodates the heating member. With this configuration, the exciting coil and the heating member can be manufactured independently and can be separated from each other. Therefore, an advantageous effect is obtained that the inspection, maintenance, repairing, etc. can be improved in workability.

According to third aspect of the invention, in each of the first and second layers the exciting coil is wound from a top portion of the coil guide member toward a bottom opening thereof. With this configuration, since winding is performed from the top portion of the coil guide member where the winding width is small toward the bottom opening where the winding width is large, the coil can be wound stably without coming loose. Therefore, an advantageous effect is obtained that the production efficiency can be increased.

According to fourth aspect of the invention, it is provided a fuser utilizing electromagnetic induction for fusing unfused toner on a recording medium by melting and pressurizing the unfused toner on the recording sheet while nipping and transporting the recording medium by a fusing nip portion, comprising a heating member that is a magnetic metal member as a rotary body; induction heating means opposed to the heating member, for causing the heating member to heat through electromagnetic induction; and a pressing member that is brought into pressure contact with the heating member or a belt member that is heated by the heating member and is rotated in a forward direction to form the fusing nip portion, wherein the induction heating means comprises an exciting coil for generating a magnetic field and a coil guide member on which the exciting coil is wound; and wherein that the exciting coil is formed in at least two layers in such a manner that a first layer is formed on a circumferential surface of the coil guide member by winding a plurality of turns and a second layer is formed around and outside the first layer on a side opposite to the coil guide member, and that winding of each of the second layer and following layers is started from a position close to a winding start position of the first layer. With this configuration, no magnetic field concentration occurs near the bottom opening of the coil guide member and a magnetic flux that leaks from the opening of the coil guide member (i.e., a useless magnetic field that does not act on the heating member) is reduced. The heating member is not influenced by an unstable magnetic field occurring in the end portion of the exciting coil. This provides an advantageous effect that the induction heating means can cause the heating member to heat uniformly without unevenness.

Since the first turn of the second layer starts from the position close to the first turn of the first layer, the profile of the voltage difference between the first and second layers is almost uniform and has no unduly-high-voltage portions, which decreases the causes of current leakage between wire sections. Since the winding start position and end position are distant from each other, a long insulation distance can be secured between them, which also decreases the causes of current leakage. As a result, an advantageous effect is obtained that a stable exciting coil can be provided.

According to fifth aspect of the invention, the coil guide member comprises an opening and a housing that is curved so as to cover the heating member and accommodates the heating member. With this configuration, the exciting coil and the heating member can be manufactured independently and can be separated from each other. Therefore, an advantageous effect is obtained that the inspection, maintenance, repairing, etc. can be improved in workability.

According to the sixth aspect of the invention, in each of the first and second layers the exciting coil is wound from a top portion of the coil guide member toward a bottom opening thereof. With this configuration, since winding is performed from the top portion of the coil guide member where the winding width is small toward the bottom opening where the winding width is large, the coil can be wound stably without coming loose. Therefore, an advantageous effect is obtained that the production efficiency can be increased.

DETAILED DESCRIPTION OF THE PREFFERRED EMBODIMNENTS

Embodiments of the present invention will be hereinafter described with reference to FIGS. 1 to 8. In these drawings, the same members are given the same reference symbol. And redundant descriptions will be omitted.

Figure 1:
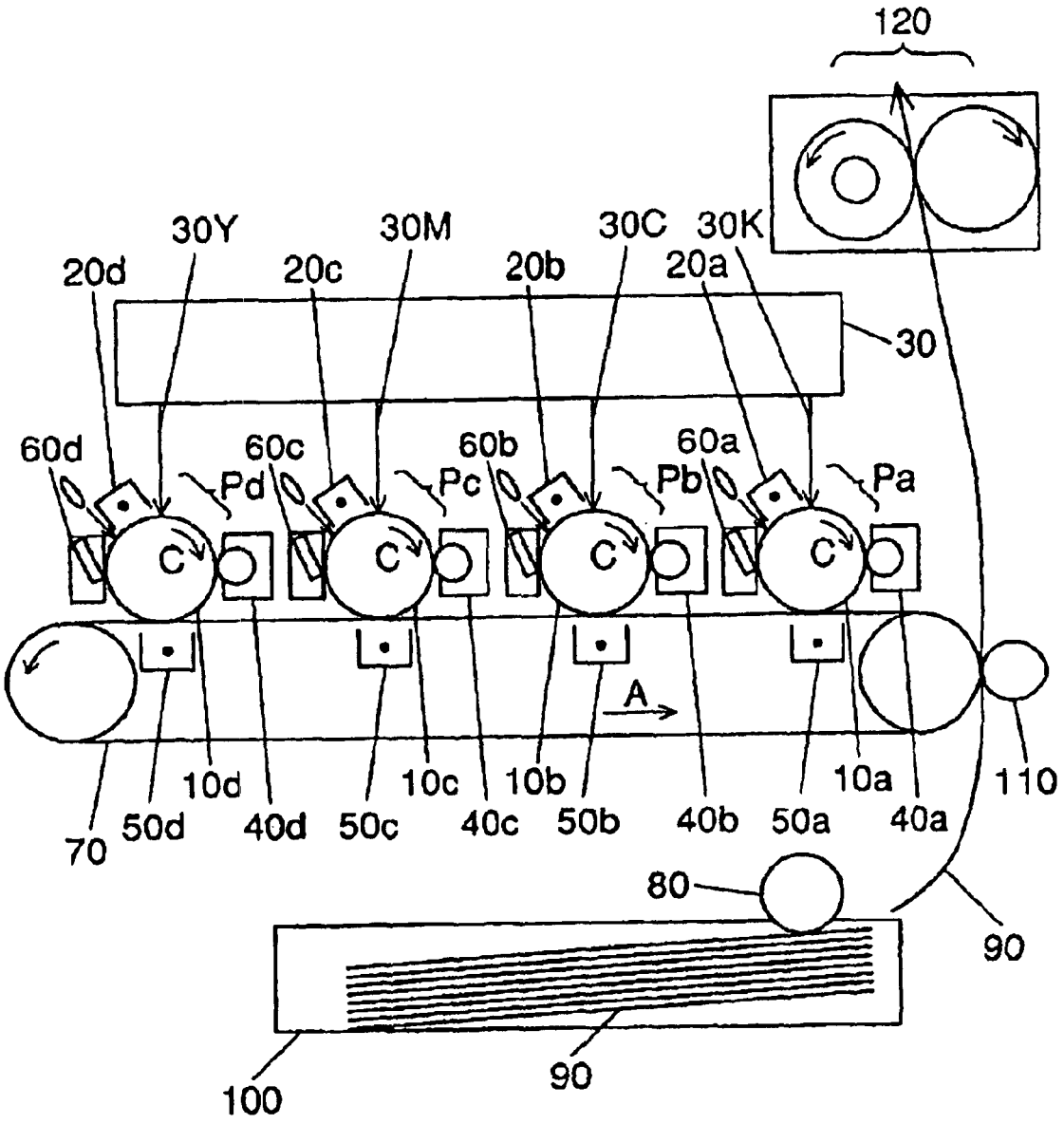
FIG. 1 illustrates the configuration of an image forming apparatus that is equipped with a fuser according to an embodiment of the invention.
Figure 2:
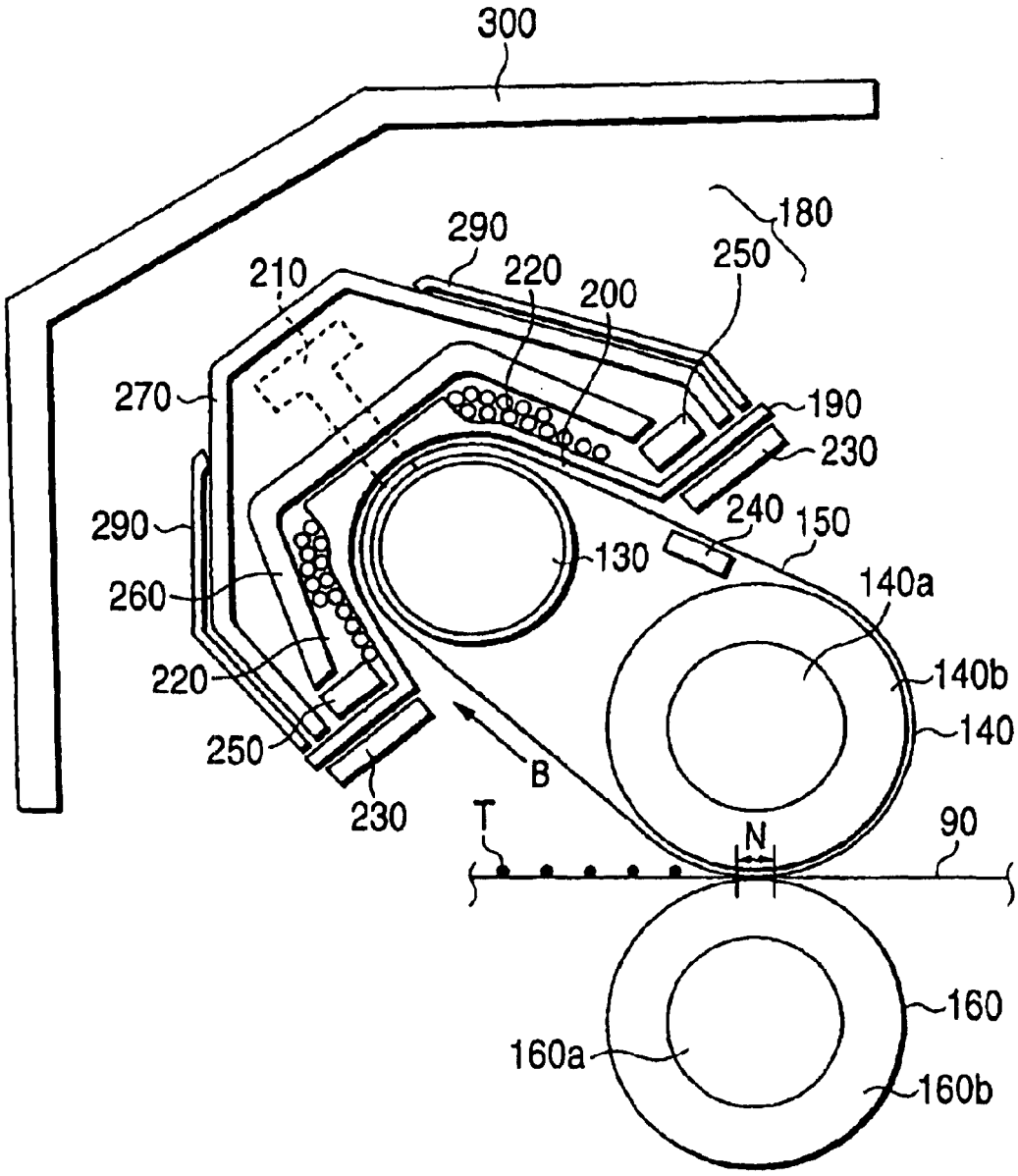
FIG. 2 illustrates the configuration of the fuser according to the embodiment of the invention that is used in the image forming apparatus of FIG. 1.
Figure 3:
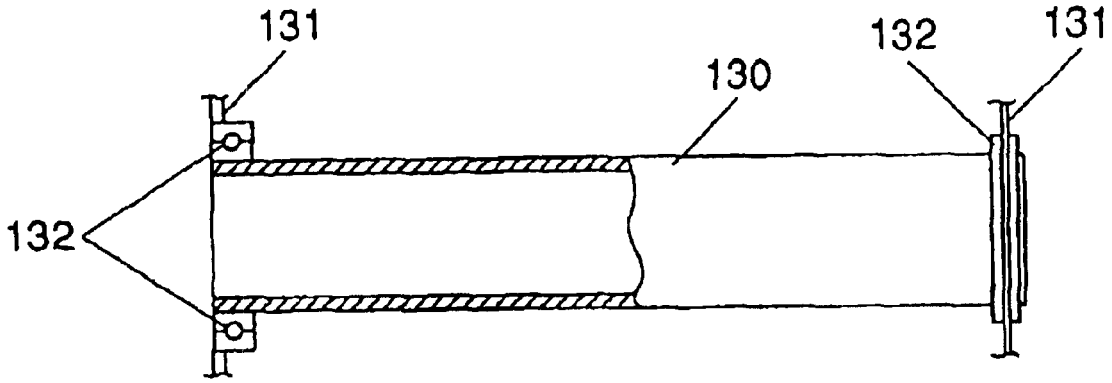
FIG. 3 is a cutaway view illustrating the structure of a heating roller that is a component of the fuser of FIG. 2.
Figure 4:
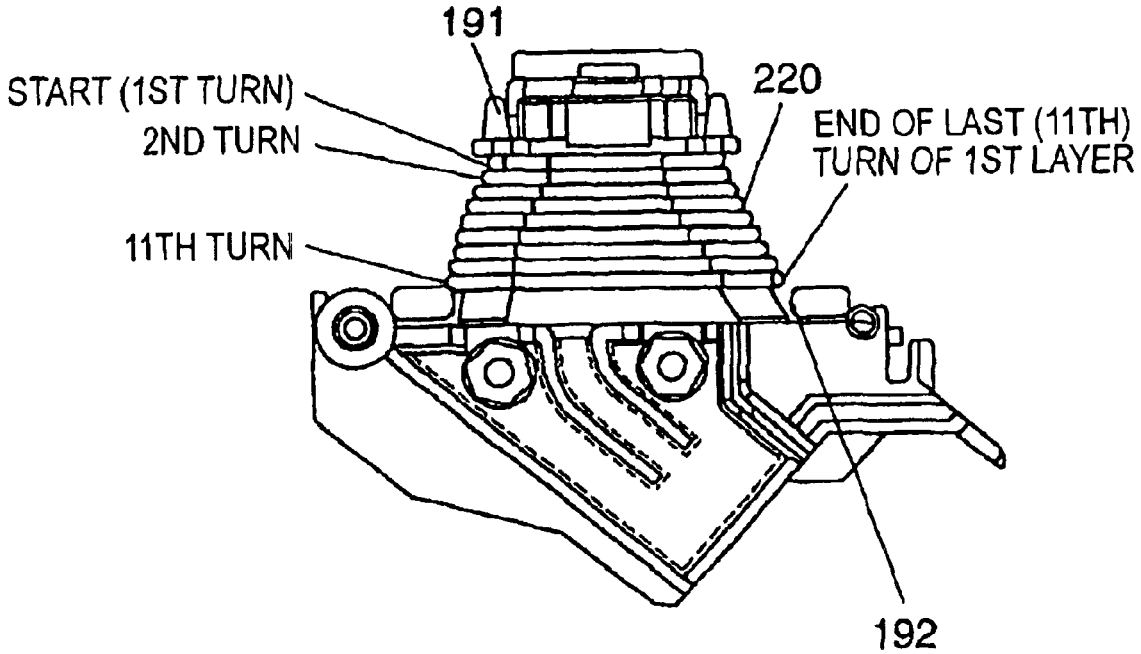
FIG. 4 illustrates how an exciting coil of an induction heating unit according to the embodiment of the invention is wound.
Figure 5:
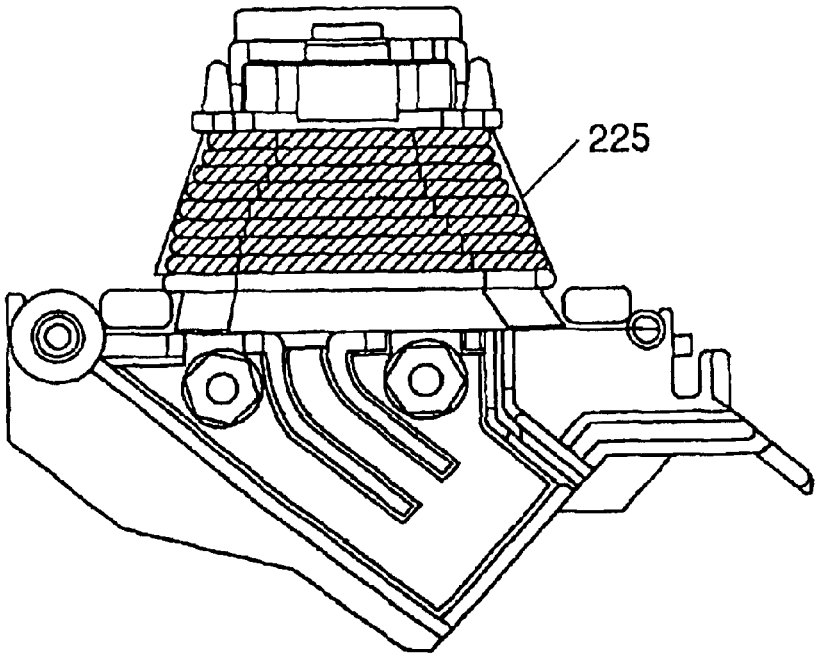
FIG. 5 illustrates how the exciting coil of the induction heating unit according to the embodiment of the invention is wound.
Figure 6:
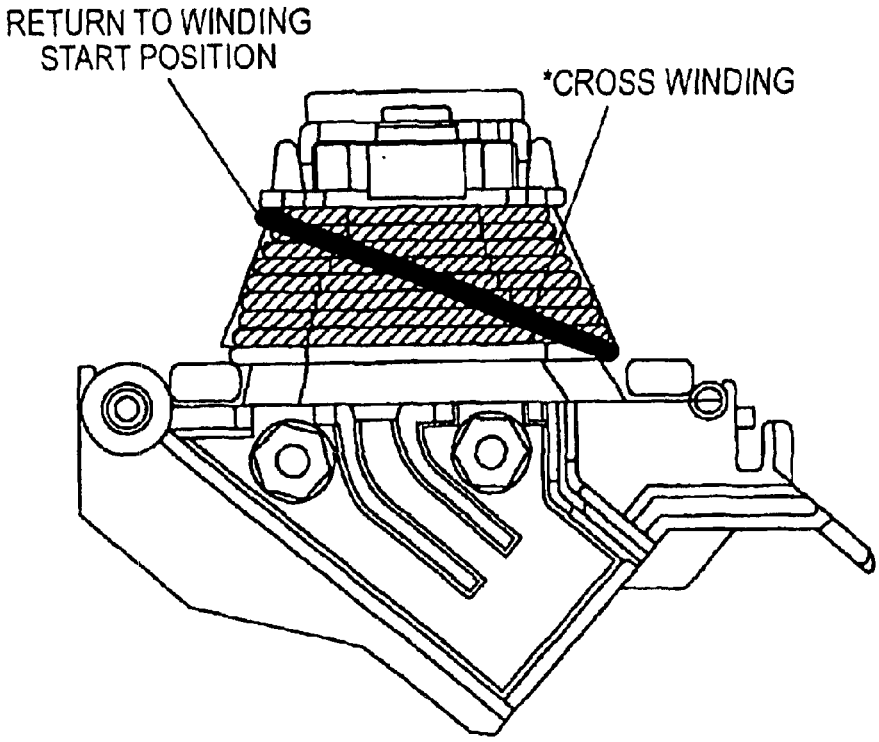
FIG. 6 illustrates how the exciting coil of the induction heating unit according to the embodiment of the invention is wound.
Figure 7:
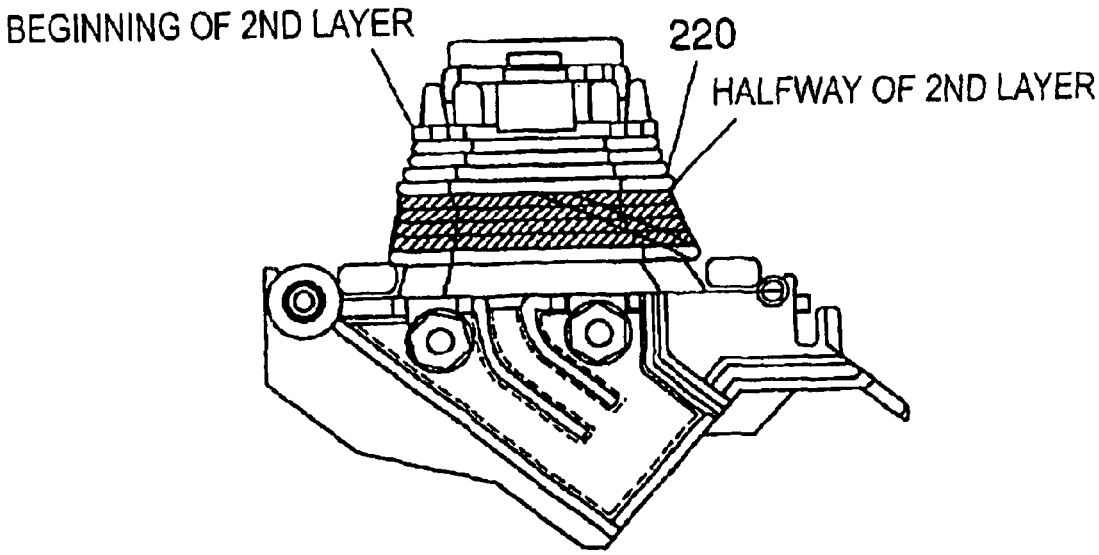
FIGS. 7(*a*) and 7(*b*) illustrate how the exciting coil of the induction heating unit according to the embodiment of the invention is wound.
Figure 7:
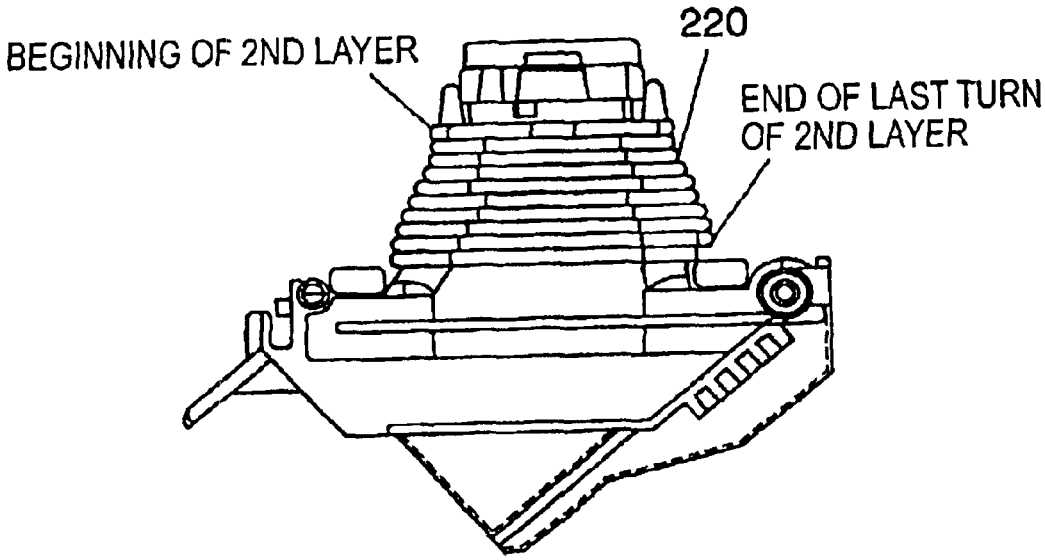
Figure 8:
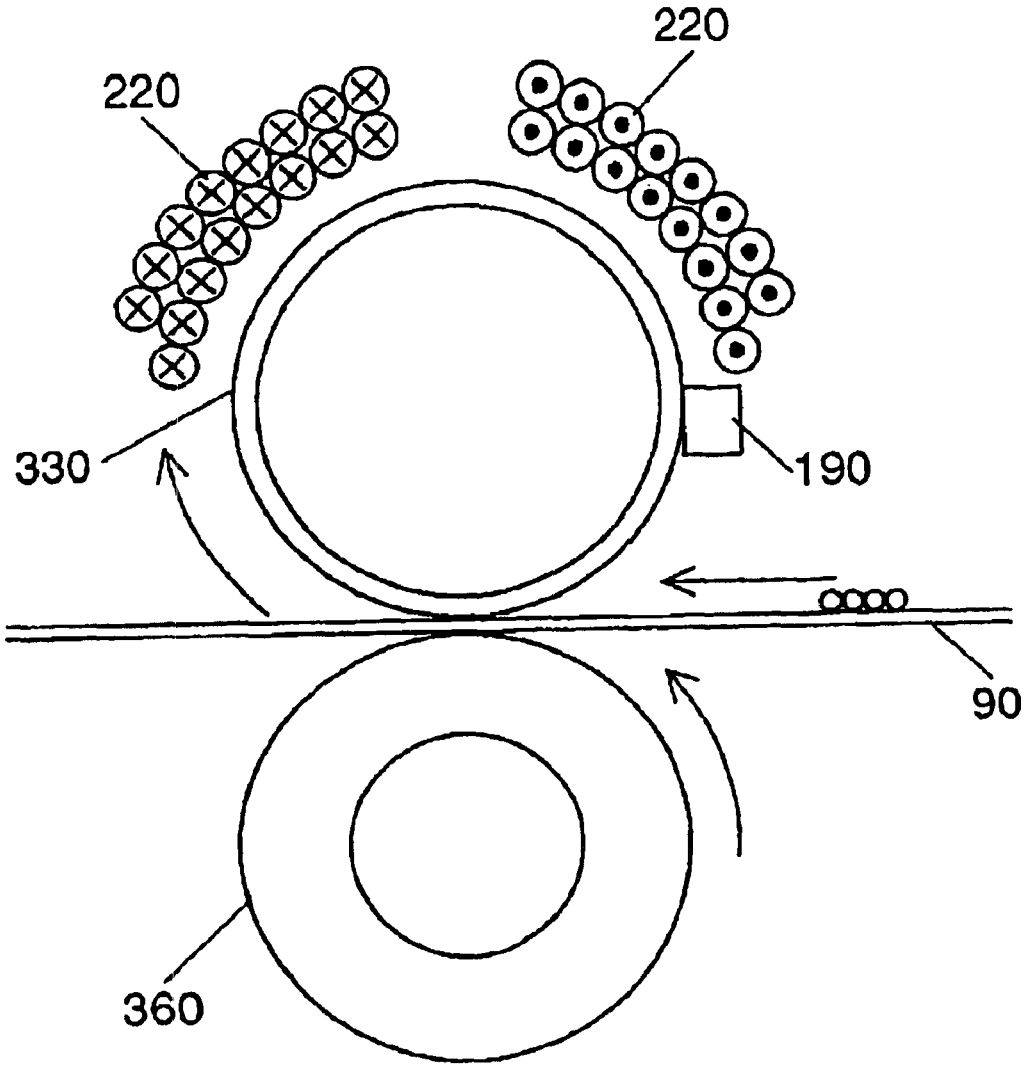
FIG. 8 illustrates the configuration of a fuser according to another embodiment of the invention.

FIG. 1 illustrates the configuration of an image forming apparatus that is equipped with a fuser according to an embodiment of the invention. FIG. 2 illustrates the configuration of the fuser according to the embodiment of the invention that is used in the image forming apparatus of FIG. 1. FIG. 3 is a cutaway view illustrating the structure of a heating roller that is a component of the fuser of FIG. 2. FIG. 4 illustrates how an exciting coil of an induction heating unit according to the embodiment of the invention is wound. FIG. 5 illustrates how the exciting coil of the induction heating unit according to the embodiment of the invention is wound. FIG. 6 illustrates how the exciting coil of the induction heating unit according to the embodiment of the invention is wound. FIGS. 7(*a*) and 7(*b*) illustrate how the exciting coil of the induction heating unit according to the embodiment of the invention is wound. FIG. 8 illustrates the configuration of a fuser according to another embodiment of the invention.

First, the image forming apparatus according to the invention will be outlined below. Among apparatus employing the xerography, the image forming apparatus that will be described in this embodiment is a tandem type apparatus in which developing units are provided for four fundamental color toners, respectively, that contribute to coloring of a color image and four color images are superimposed on each other on a transfer body and transferred to a sheet collectively. However, it goes without saying that the invention is not limited to tandem-type image forming apparatus and can be used in any kinds of image forming apparatus irrespective of the number of developing units and the presence/absence of an intermediate transfer body.

As shown in FIG. 1, charging units 20*a*, 20*b*, 20*c*, and 20*d*, an exposure unit 30, developing units 40*a*, 40*b*, 40*c*, and 40*d*, transfer units 50*a*, 50*b*, 50*c*, and 50*d*, and cleaning units 60*a*, 60*b*, 60*c*, and 60d are disposed around photoreceptor drums 10*a*, 10*b*, 10*c*, and 10*d*, respectively. The charging units 20*a*, 20*b*, 20*c*, and 20*d* charge the surfaces of the photoreceptor drums 10*a*, 10*b*, 10*c*, and 10*d* uniformly to prescribed voltages, respectively. The exposure unit 30 forms electrostatic latent images by applying scanning laser beams 30K, 30C, 30M, and 30Y corresponding to image data of particular colors to the charged photoreceptor drums 10*a*, 10*b*, 10*c*, and 10*d*, respectively. The developing units 40*a*, 40*b*, 40*c*, and 40*d* visualize the electrostatic latent images formed on the photoreceptor drums 10*a*, 10*b*, 10*c*, and 10*d*, respectively. The transfer units 50*a*, 50*b*, 50*c*, and 50*d* transfer visualized toner images on the photoreceptor drums 10*a*, 10*b*, 10*c*, and 10*d* to an endless intermediate transfer belt (i.e., intermediate transfer body) 70, respectively. The cleaning units 60*a*, 60*b*, 60*c*, and 60*d* remove, from the photoreceptor drums 10*a*, 10*b*, 10*c*, and 10*d*, toner that remains thereon after the transfer of the toner images to the intermediate transfer belt 70, respectively.

The exposure unit 30 is disposed so as to have a prescribed inclination with respect to the photoreceptor drums 10*a*, 10*b*, 10*c*, and 10*d*. In the illustrated example, the intermediate transfer belt 70 is rotated in the direction indicated by an arrow A. Image forming stations Pa, Pb, Pc, and Pd form a black image, a cyan image, and a magenta image, and a yellow image, respectively. The monochrome images of the respective colors formed on the respective photoreceptor drums 10*a*, 10*b*, 10*c*, and 10*d* are sequentially transferred to the intermediate transfer belt 70 in a superimposed manner, whereby a full-color image is formed.

A sheet feed cassette 100 that house sheets (recording media) 90 such as printing sheets is disposed at the bottom of the apparatus. A sheet feed roller 80 sends out sheets 90 one by one from the sheet feed cassette 100 to a sheet transport path.

A sheet transfer roller 110 and a fuser 120 are disposed adjacent to the sheet transport path. The sheet transfer roller 110 is brought into contact with the outer circumferential surface of the intermediate transfer belt 70 over a prescribed width and transfers a color image formed on the intermediate transfer belt 70 to a sheet 90. The fuser 120 fuses, on the sheet 90, the transferred color image utilizing pressure and heat as the rollers rotate while nipping the sheet 90.

In the image forming apparatus having the above configuration, first, a latent image corresponding to a black component of image information is formed on the photoreceptor drum 10*a* by the charging unit 20*a* of the image forming station Pa and the exposure unit 30. The latent image is visualized into a black toner image by the developing unit 40*a* having a black toner and transferred to the intermediate transfer belt 70 by the transfer unit 50*a*.

While the black toner image is transferred to the intermediate transfer belt 70, in the image forming station Pb a latent image corresponding to a cyan component and visualized into a cyan toner image by the developing unit 40*b* by using a cyan toner. The cyan toner image is transferred, by the transfer unit 50*b* of the image forming station Pb, to the intermediate transfer belt 70 to which the black toner image has been transferred in the image forming station Pa, whereby the cyan toner image is superimposed on the black toner image.

Subsequently, a magenta toner image and a yellow toner image are formed by similar methods. After completion of the superimposition of the toner images of the four colors on the intermediate transfer belt 70, the toner images of the four colors are transferred collectively by the sheet transfer roller 110 to a sheet 90 that has been fed from the sheet feed cassette 100 by the sheet feed roller 80. The transferred toner images are heat-fused on the sheet 90 by the fuser 120, whereby a full-color image is formed on the sheet 90.

Next, the fuser 120 used in the above image forming apparatus will be described.

As shown in FIG. 2, the fuser 120 is composed of a heating roller (heating member) 130, a fusing roller 140 that is caused to heat by an induction heating unit 180 through electromagnetic induction, a fusing roller 140 that is disposed parallel with the heating roller 130, an endless heat-resistant belt (i.e., toner heating medium) 150 that is stretched between the heating roller 130 and fusing roller 140, heated by the heating roller 130, and rotated in the direction indicated by an arrow B by the rotation of at least one of the rollers 130 and 140, and a pressure roller 160 that is brought into pressure contact with the fusing roller 140 via the heat-resistant belt 150 and that rotates in the forward direction with respect to the heat-resistant belt 150.

The heating roller 130 is a hollow-cylinder-like magnetic metal member (rotary body) made of iron, cobalt, nickel, an alloy of these metals, or the like and has an outer diameter of 20 mm, for example, and a thickness of 0.3 mm, for example. As such, the heating roller 130 has a low heat capacity and hence its temperature is increased rapidly.

As shown in FIG. 3, both ends of the heating roller 130 are rotatably supported by bearings 132 that are fixed to support side plates 131 that are galvanized steel plates, respectively. The heating roller 130 is rotated by a drive unit of an apparatus main body (not shown). The heating roller 130 is made of a magnetic material that is an ion-nickel-chromium alloy, and its Curie point is adjusted to 300° C. of higher. The heating roller 130 assumes a pipe-like shape having a thickness of 0.3 mm.

To attain high releasability, the surface of the heating roller 130 is coated with a 20-$\mu$m-thick release layer (not shown) made of a fluororesin. The release layer may be made of a resin or rubber exhibiting high releasability such as PTFE, PFA, FEP, silicone rubber, or fluororubber or a mixture thereof. Where the heating roller 130 is used for fusing monochrome images, securing only high releasability is satisfactory. However, where the heating roller 130 is used for fusing color images, it is desirable that the heating roller 130 also be elastic. In this case, it is necessary to form a thicker rubber layer.

The fusing roller 140 is composed of a core bar 140*a* made of a metal material such as stainless steel and an elastic member 140*b* that covers the core bar 140*a*. The elastic member 140*b* is made of heat-resistant silicone rubber in solid or foamed form. To form a fusing nip portion N having a prescribed width between the fusing roller 140 and the pressure roller 160 with pressing force from the pressure roller 160, the outer diameter of the fusing roller 140 and the pressure roller 160 is set to about 30 mm, that is, set larger than that of the heating roller 130. The thickness and the hardness of the elastic member 140*b* are set to about 3–8 mm and about 15–50° in Asker hardness (6–25° in JIS-A hardness), respectively. With the above configuration, the heat capacity of the heating roller 130 is smaller than that of the fusing roller 140, whereby the heating roller 130 is heated quickly and its warm-up time is shortened.

The heat-resistant belt 150 that is stretched between the heating roller 130 and the fusing roller 140 is heated at the position where the heat-resistant belt 150 contacts the heating roller 130 being heated by an induction heating unit 180.

As the heating roller 130 and the fusing roller 140 are rotated, the inner surface of the heat-resistant belt 150 is heated continuously, as a result of which the heat-resistant belt 150 is heated in its entirety.

The heat-resistant belt 150 is a composite layer belt that is composed of a heating layer and a release layer that covers the surface of the heating layer (not shown) The heating layer has, as a base material, a magnetic metal such as iron, cobalt, or nickel or an alloy having those metals as base materials. The release layer is an elastic member made of silicone rubber, fluororubber, or the like.

Where the composite layered belt is used, heat is applied from the induction heating unit 180 to the heat resistance belt 150 through the heating roller 130, and further it is directly applied from the induction heating unit 180 to the heat resistance belt 150. Additional useful effects are that the heating efficiency is improved and the heating response becomes quick.

Even if foreign matter is introduced between, for example, the heat-resistant belt 150 and the heating roller 130 for some reason, resulting temperature unevenness would be low because the heat-resistant belt 150 itself, more specifically, its heating layer, generates heat through electromagnetic induction. The reliability of fusing is therefore high.

A thickness of the heating layer is preferably within a range from approximately 20 $\mu$m to 50 $\mu$m, more preferably about 30 $\mu$m.

As shown in FIG. 2, the pressure contact roller 160 is composed of a core bar 160*a* and an elastic member 160*b* that is provided on the surface of the core bar 160*a*. The core bar 160*a* is a cylindrical member made of a metal that is high in thermal conductivity, such as copper or aluminum. The elastic member 160*b* is high in both heat resistance and toner releasability. The core bar 160*a* may be made of SUS instead of the above metals.

The pressure roller 160 presses the fusing roller 140 via the heat-resistant belt 150 and thereby forms the fusing nip portion N for transporting a sheet 90 while nipping it. In this embodiment, since the hardness of the pressure roller 160 is set higher than that of the fusing roller 140, the pressure roller 160 cuts into the fusing roller 140 (and the heat-resistant belt 150), whereby the sheet 90 follows the cylindrical shape of the surface of the pressure roller 160. This provides an advantage that the sheet 90 can be released easily from the surface of the heat-resistant belt 150. Whereas like the fusing roller 140 the pressure roller 160 is about 30 mm in outer diameter, the pressure roller 160 is about 2–5 mm in thickness (i.e., thinner than the fusing roller 140) and 20–60° in Asker hardness (6–25° in JIS-A hardness; harder than the fusing roller 140 as mentioned above). The temperature of the belt inner surface is detected by a temperature detecting unit 240 that is disposed near the entrance of the fusing nip portion N and is in contact with the inner surface of the heat-resistant belt 150. The temperature detecting unit 240 employs a temperature sensing element having a high thermal response speed, such as a thermistor.

Next, the configuration of the induction heating unit 180 will be described.

As shown in FIG. 2, the induction heating unit 180 which heats the heating roller 130 by electromagnetic induction is opposed to outer circumferential surface of the heating roller 130. The induction heating unit 180 is equipped with a support frame (coil guide member) 190 having a housing 200 for accommodating the heating roller 130, the housing 200 being curved so as to cover the heating roller 130. The support frame 190 is made of a flame-resistant resin.

A major constituent element of the induction heating unit 180 is an exciting coil 220. The induction heating unit 180 heats the heat resistance belt 150 or the heating roller 130 in the following mechanism. Current is fed to the exciting coil 220. In turn, the exciting coil 220 develops a magnetic flux passing through the hollowed part thereof. The magnetic flux interlinks with the heat resistance belt 150 or the heating roller 130 through the support frame 190. At this time, eddy current is generated at the interlinking part in such a direction as to impede a change of the magnetic flux. By resistance of the heat resistance belt 150 or the heating roller 130, Joule heat is generated in the surface of the heat resistance belt 150 or the heating roller 130.

A thermostat 210 is disposed at such a position as to be opposed to the heating roller 130. A temperature detecting portion of the thermostat 210 projects from the support frame 190 toward the heating roller 130 and the heat-resistant belt 150. With this measure, the temperature of the heating roller 130 and the heat-resistant belt 150 is detected and a power circuit (not shown) is shut off forcibly when an abnormal temperature is detected.

An exciting coil 220 as a magnetic field generating unit that is a bundle of a surface-insulated wire is wound on the outer circumferential surface of the support frame 190. The exciting coil 220 is formed by winding a long, single exciting coil wire around the support frame so as to extend in the axial direction of the heating roller 130 (see FIG. 8). The coil winding length is approximately equal to the length of the region where the heat-resistant belt 150 is in contact with the heating roller 130.

Connected to drive power source (not shown) having a frequency-variable oscillation circuit, the exciting coil 22 is supplied with a high-frequency AC current of 10 kHz to 1 MHz (preferably 20 to 800 kHz) from the drive power source and generates an AC magnetic field. The AC magnetic field acts on the heating roller 130 and the heating layer of the heat-resistant belt 150 in the region where the heat-resistant belt 150 is in contact with the heating roller 130 and its vicinity, whereby eddy current flows there in such a direction as to impede the change of the AC magnetic field.

The eddy current causes generation of Joule heat that depends on the resistivity of each of the heating roller 130 and the heating layer of the heat-resistant belt 150. In this manner, the heating roller 130 and the heating layer of the heat-resistant belt 150 are heated by electromagnetic induction mainly in the region where the heat-resistant belt 150 is in contact with the heating roller 130 and its vicinity.

A short ring 230 is disposed outside the support frame 190 so as to surround the housing 200. Eddy current occurs in the short ring 230 in such a direction as to cancel out a leakage flux, which would otherwise leaks out, of the magnetic flux that is generated by the current-flowing exciting coil 220. When eddy current occurs, a magnetic field is generated in such a direction as to impede the leakage flux according to Fleming's law, whereby extraneous emission due to the leakage flux is prevented.

For example, the short ring 230 is made of copper or aluminum each of which is highly conductive. It is sufficient to dispose the short ring 230 at such a position that it can generate a magnetic flux at least capable of canceling out a leakage flux.

An exciting coil core 250 is disposed on the top surface of the short ring 230 in such a manner as to surround the housing 200 of the support frame 190 like the short ring 230 does. A C-shaped coil core 260 is disposed above the exciting coil core 250 in such a manner as to stride the housing 200.

The exciting coil core 250 and the C-shaped coil core 260 increase the inductance of the exciting coil 220 and thereby strengthen the electromagnetic coupling between the exciting coil 220 and the heating roller 130. This allows the same coil current to input more electric power to the heating roller 130 and thereby makes it possible to realize a fuser having a shorter warm-up time.

A housing 270 that covers the inside of the induction heating unit 180 is provided on the opposite side of the exciting coil 220 to the heating roller 130. The housing 270 is made of a resin, for example, assumes such a roof shape as to cover the C-shaped coil core 260 and the thermostat 210, and is attached to support frame 190. The housing 270 may be made of a material other than a resin. The housing 270 is formed with a plurality of radiation holes (not shown) through which to emit heat outside that emanates from the internal components such as the support frame 190, the exciting coil 220, and the C-shaped coil core 260.

A short ring 290 that is shaped so as not to close the radiation holes of the housing 270 is attached to the support frame 190.

As in the case of the above-described short ring 230, eddy current occurs in the short ring 290 in such a direction as to cancel out a slight leakage flux that would otherwise leak out of the back side of the C-shaped coil core 260 etc., whereby extraneous emission due to the leakage flux is prevented.

A shielding plate 300 is provided on the side opposite to the heating roller 130 with respect to the exciting coil 220.

The shielding plate 300 is made of a ferromagnetic metal, such as iron. The shielding plate blocks magnetic fluxes leaking from the rear side of he C-coil core 260 and the like, whereby unnecessary radiation is prevented, and hence noise generation in other members or devices is suppressed.

The manner of winding of the exciting coil 220 on the support frame (coil guide member) 190 will be described below with reference to FIGS. 2 and 4–7.

As shown in FIG. 2 which is the cross-section taken perpendicularly to the rotation axis of the heating roller 130, the bundle of exciting coil 220 is disposed on the circumferential surface of the support frame 190 that covers the top half of the heating roller 130 in such a manner that wire sections are arranged close to each other in the circumferential direction of the heating roller 130 so as to form two layers. Adjacent ones of the wire sections extending from one side where one end of the heating roller 130 exists to the other side where the other end of the heating roller 130 exists are in close contact with each other, and adjacent ones of the wire sections extending from the other side to the one side are in close contact with each other.

It goes without saying that the invention is not limited to the case of the two layer structure.

FIG. 4 illustrates how the exciting coil 220 of the induction heating unit 180 is wound according to the embodiment of the invention and shows an appearance as viewed from one end in the longitudinal direction of the support frame 190. The first layer of the exciting coil 220 is wound on the circumferential surface of the support frame 190 in such a manner that turns from a first turn to an 11th turn that is the last turn of the first layer are wound sequentially from a position close to a top portion 191 toward a bottom opening 192 (the number of turns is not limited to 11). After the end of the last turn of the first layer has been applied to the support frame 190, the wire section of the exciting coil 220 from the end (that is close to the bottom opening 192 of the support frame 190) of the 11th turn to the beginning (that is close to the top portion 191) of a 12th turn (i.e., the start turn of the second layer that is outside the first layer) is stretched above (outside) the first layer and crosses the first layer so that the 12th turn will be laid on the first layer from outside (see FIG. 6). The above wire section is stretched and crosses the first layer so that the beginning of the start turn (12th turn) of the second layer is located right over (outside) the beginning of the start turn (first turn) of the first layer or in its vicinity.

After the above wire section has been stretched from the end of the 11th turn to the beginning of the 12th turn and the winding of the first layer has finished, the winding of the second layer is started so that an insulating member 225 will cover the first-layer coil and be interposed between the first and second layers (see FIG. 5). The insulating member 225 may be provided only in the coil crossing area.

FIG. 7(*a*) shows a state that part of the second layer of the exciting coil 220 has been formed, and FIG. 7(*b*) shows a state that the winding of the second layer has finished.

The above embodiment is such that the exciting coil 220 has the two layer structure. Where the exciting coil 220 is formed in three or more layers, the exciting coil 220 is wound in such a manner that the wire section from the end of the last turn of the second layer to the beginning of the start turn of the third layer crosses the second layer as in the case of the wire section connecting the first and second layers.

The exciting coil 220 thus wound causes the heating roller 130 to heat through electromagnetic induction. A magnetic flux that is generated by the exciting coil 220 as an AC current originating from the exciting circuit (not shown) flows through it penetrates through the heating roller 130 in its circumferential direction because of the magnetism of the heating roller 130, and is generated and disappears repeatedly. Induction current occurring in the heating roller 130 because of such a magnetic flux variation flows through almost only the surface layer of the heating roller due to the skin effect and generates Joule heat.

The fuser that has been described above with reference to FIG. 2 is such that the induction heating unit according to the invention is applied to the fuser that performs fusing via the heat-resistant belt 150. On the other hand, as shown in FIG. 8, it is easy to apply the induction heating unit shown in FIGS. 4–7 to a fuser that does not employ a belt.

Reference numeral 330 denotes a heating roller as a heating member. The heating roller 330 is rotated by a drive unit of the apparatus main body (not shown). The heating roller 330 is made of a magnetic material that is an iron-nickel-chromium alloy, and its Curie point is adjusted to 300° C. of higher. The heating roller 330 assumes a pipe-like shape having a thickness of 0.3 mm.

To attain high releasability, the surface of the heating roller 330 is coated with a 20-$\mu$m-thick release layer (not shown) made of a fluororesin. The release layer may be made of a resin or rubber exhibiting high releasability such as PTFE, PFA, FEP, silicone rubber, or fluororubber or a mixture thereof. Where the heating roller 330 is used for fusing monochrome images, securing only high releasability is satisfactory. However, where the heating roller 330 is used for fusing color images, it is desirable that the heating roller 330 also be elastic. In this case, it is necessary to form a thicker rubber layer.

Reference numeral 360 denotes a pressure roller as a pressing member. The pressure roller 360 is made of silicone rubber having JIS-A hardness of 65°. The pressure roller 360 is brought into pressure contact with the heating roller with pressing force of 20 kgf to form a nip portion. In this state, the pressure roller 360 is rotated as the heating roller 330 rotates. The pressure roller 360 may be made of another heat-resistant resin or rubber such as a fluororesin or fluororubber. To enhance the abrasion resistance and the releasability, it is desirable that the surface of the pressure roller 360 be coated with a resin or rubber such as PFA, PTFE, FEP or a mixture thereof. To prevent heat radiation, it is desirable that the pressure roller 360 be made of a material having low thermal conductivity.

Next, comparison examples will be explained with reference to FIGS. 9(*a*) to 9(*d*).

Figure 9:
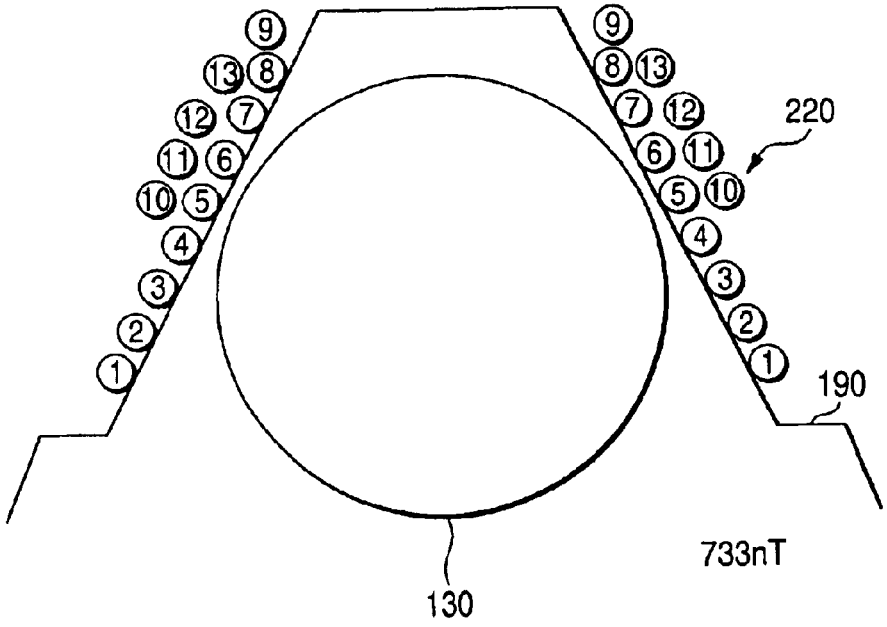
FIGS. 9(*a*) to 9(*d*) show comparison examples of the present invention.
Figure 9:
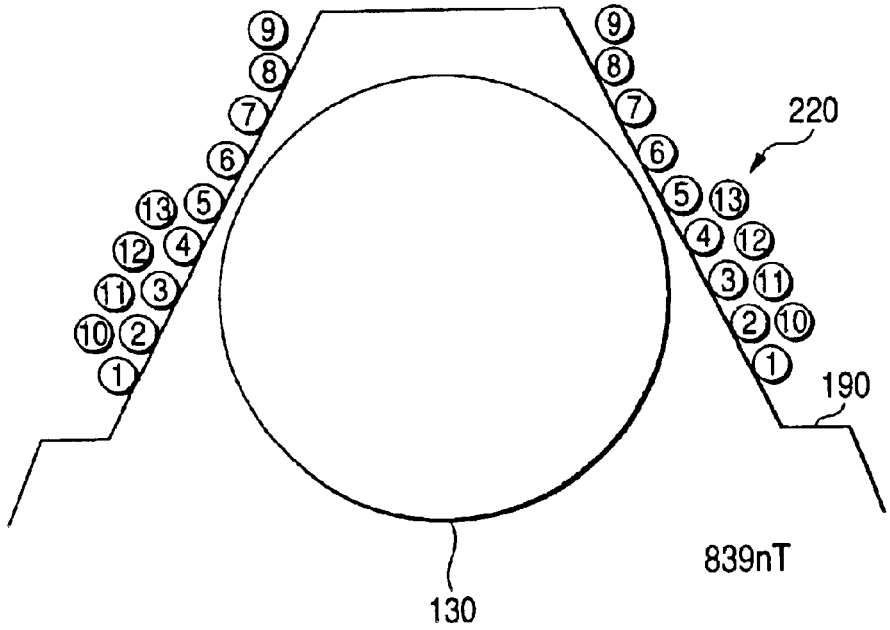
Figure 9:
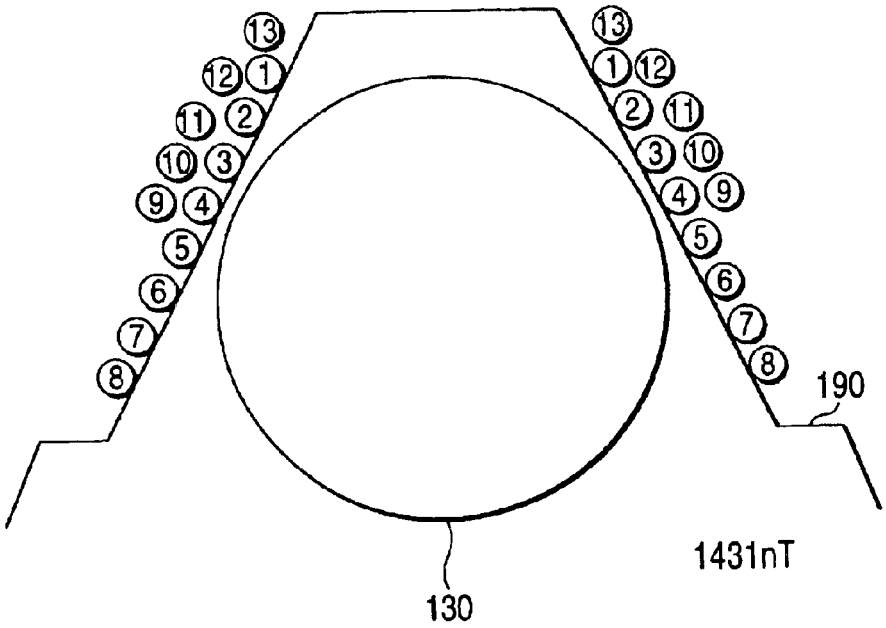
Figure 9:
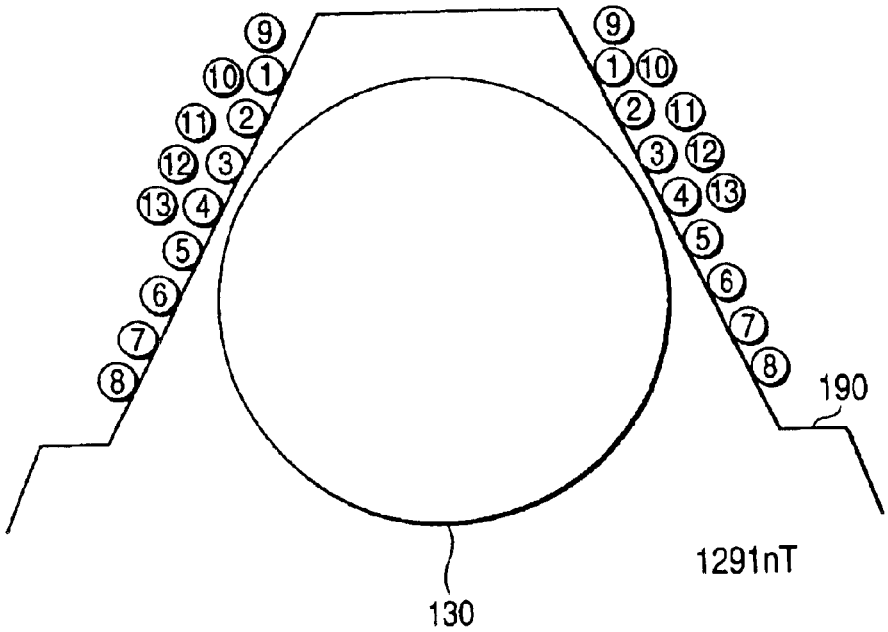

Both exciting coils shown in FIGS. 9(*a*) and 9(*b*) are designed for 100 V. The first layer consists of 9 turns and the second layer consists of 4 turns (13 turns in total). The inductance is 43.5 to 46.6 $\mu$H.

When the second layer was wound on the top portion of the core member as shown in FIG. 9(*a*), a measured magnetic flux density was 733 nT. On the other hand, when the second layer was wound on the foot portion (lower portion) of the core member as shown in FIG. 9(*b*), a measured magnetic flux density was 839 nT.

The degree of magnetic flux leakage in case of FIG. 9(*a*) is less than that in the case of FIG. 9(*b*) by 106 nT. It is considered that the leakage magnetic flux increased because of an increased distance of the second-layer coil from the heating roller 130 in the case of FIG. 9(*b*).

In exciting coils designed for 220 V, the first layer consists of 11 turns, the second layer consists of 9.5 turns, and the third layer consists of 4.5 turns (25 turns in total) The inductance is in a range of 170 to 180 $\mu$H.

Next, measurement results for comparison of cases in which the second layers of the coils were wound on the top portion with varied manners of winding are as follows, though various experimental conditions are different than in the cases of the other drawings. As apparent from FIG. 9(*c*), in this case, second layer windings are wound from foot to top. In this case, the degree of magnetic flux leakage shows 1431 nT. Contrary, in the case of FIG. 9(*d*), second layer windings are returned to top portion, and wound to foot portion. In this case, the degree of magnetic flux leakage shows 1291 nT. Namely, winding manner shown in FIG. 9(*d*) is better than that of FIG. 9(*c*) in view of the leakage of magnetic flux.

As described above, in the heating device or the fuser that employs electromagnetic induction heating, the exciting coil is formed in at least two layers in such a manner that the first layer is formed on the circumferential surface of the coil guide member by winding a plurality of turns and the second layer is formed around and outside the first layer on the side opposite to the coil guide member. And winding of each of the second and following layers is started from a position close to the winding start position of the first layer. With this configuration, the last turn of the first layer is not laid on the first turn of the second layer that is located outside the first layer. Therefore, no magnetic field concentration occurs near the bottom opening of the coil guide member. This provides an advantageous effect that the induction heating unit can cause the heating member to heat uniformly without unevenness.

Since the first turn of the second layer starts from the position close to the first turn of the first layer, the profile of the voltage difference between the first and second layers is almost uniform and has no unduly-high-voltage portions, which decreases the causes of current leakage between wire sections. Since the winding start position and end position are distant from each other, a long insulation distance can be secured between them, which also decreases the causes of current leakage and makes it possible to provide a stable exciting coil.

Further, since winding is performed from the top portion of the coil guide member where the winding width is small toward the bottom opening where the winding width is large, the coil can be wound stably without coming loose. The production efficiency can thereby be increased.

This application is based upon and claims the benefit of priority of Japanese Patent Applications No. 2003-009451 filed on Jan. 17, 2003 and No 2003-023828 filed on Jan. 31, 2003, the contents of which are incorporated herein by reference in its entirety.

What is claimed is:

1. A heating device utilizing electromagnetic induction, comprising:

a heating member; and induction heating means opposed to the heating member for causing the heating member to heat through electromagnetic induction, the induction heating means including an exciting coil for generating a magnetic field and a coil guide member on which the exciting coil is wound, wherein the exciting coil is formed in at least two layers in such a manner that a first layer is formed on a circumferential surface of the coil guide member by winding a plurality of turns and a second layer is formed around and outside the first layer on a side opposite to the coil guide member, and winding of each of the second layer and following layers is started from a position close to a winding start position of the first layer.

2. The heating device utilizing electromagnetic induction according to claim 1, wherein the coil guide member comprises an opening and a housing that is curved so as to cover the heating member and accommodates the heating member.

3. The heating device utilizing electromagnetic induction according to claim 2, wherein, in each of the first, second, and following layers the exciting coil is wound from a top portion of the coil guide member toward a bottom opening thereof.

4. A fuser utilizing electromagnetic induction for fusing unfused toner on a recording medium by melting and pressurizing the unfused toner on the recording sheet while nipping and transporting the recording medium by a fusing nip portion, comprising:

a heating member that is a magnetic metal member as a rotary body;

induction heating means opposed to the heating member, for causing the heating member to heat through electromagnetic induction, the induction heating means including an exciting coil for generating a magnetic field and a coil guide member on which the exciting coil is wound; and a pressing member that is brought into pressure contact with the heating member or a belt member that is heated by the heating member and is rotated in a forward direction to form the fusing nip portion, wherein the exciting coil is formed in at least two layers in such a manner that a first layer is formed on a circumferential surface of the coil guide member by winding a plurality of turns and a second layer is formed around and outside the first layer on a side opposite to the coil guide member, and winding of each of the second layer and following layers is started from a position close to a winding start position of the first layer.

5. The fuser utilizing electromagnetic induction according to claim 4, wherein the coil guide member comprises an opening and a housing that is curved so as to cover the heating member and accommodates the heating member.

6. The fuser utilizing electromagnetic induction according to claim 5, wherein, in each of the first and second layers the exciting coil is wound from a top portion of the coil guide member toward a bottom opening thereof.

7. A heating device for an image forming apparatus comprising:

an exciting coil;

a heating roller that is induction-heated through a magnetic field of the exciting coil;

a fusing roller for thermally fusing an unfused image on a recording medium;

a heat conduction belt stretched between the heating roller and the fusing roller, for transmitting heat from the heating roller to the fusing roller; and a core member that is shaped like a pyramid so as to cover part of the heating roller and on which the exciting coil is wound, wherein the exciting coil is wound in more layers on a top portion of the pyramid-shaped core member than on a foot portion thereof.

8. The heating device for an image forming apparatus according to claim 7, wherein the exciting coil is wound in such a manner that a first layer is wound from the top portion of the pyramid-shaped core member to the foot portion thereof, then the exciting coil is returned to the top portion, and then a second layer is wound from the top portion.

9. The heating device for an image forming apparatus according to claim 7, further comprising a ring that is made of a conductive metal and disposed in the foot portion of the core member.

10. The heating device for an image forming apparatus according to claim 8, further comprising a ring that is made of a conductive metal and disposed in the foot portion of the core member.

* * * * *